United States Patent [19]

Chass

[11] 4,347,491

[45] Aug. 31, 1982

[54] ROTARY VARIABLE DIFFERENTIAL TRANSFORMER WITH SUBSTANTIALLY LINEAR OUTPUT

[75] Inventor: Jacob Chass, Rego Park, N.Y.

[73] Assignee: Pickering & Company, Inc., Plainview, N.Y.

[21] Appl. No.: 230,338

[22] Filed: Feb. 2, 1981

[51] Int. Cl.[3] ..... H01F 21/06

[52] U.S. Cl. ..... 336/135

[58] Field of Search ..... 336/130, 131, 132, 134, 336/135, 120

[56] References Cited

U.S. PATENT DOCUMENTS

| | | | |
|---|---|---|---|
| 1,989,172 | 1/1935 | Markley | 336/135 X |
| 2,436,639 | 2/1948 | Faws | 336/135 X |
| 2,488,734 | 11/1949 | Mueller | 336/135 |
| 3,531,750 | 9/1970 | Malcolm et al. | 336/135 |

*Primary Examiner*—Thomas J. Kozma

*Attorney, Agent, or Firm*—Kane, Dalsimer, Kane, Sullivan and Kurucz

[57] ABSTRACT

A rotary variable differential transformer is provided having a substantially linear output over ±35° of rotation of the rotor. Two secondary windings in series opposition extend over adjacent nominal quadrants of the stator. A primary winding extends about substantially half the stator. The rotor includes two diametrically opposed pole pieces each defining arcuate segments. One segment is approximately one half the arcuate length spanned by the secondaries and the other segment one third the arcuate length of the remainder of the stator.

7 Claims, 5 Drawing Figures

ROTARY VARIABLE DIFFERENTIAL TRANSFORMER WITH SUBSTANTIALLY LINEAR OUTPUT

BACKGROUND OF THE INVENTION

The present invention relates to rotary variable differential transformers (RVDT's) and in particular to an RVDT having an extremely linear output.

RVDT's are used in control and measurement devices to encode a displacement into an analog electrical signal. They find use, for example, in aircraft, ships, machine tools and the like as measurement and control transducers. In the main, such RVDT include one or more primary and secondaries windings, a rotor and a stator. A shift in the position of the rotor relative to the stator causes a change in the output voltage (measured across the secondary winding) with respect to the input voltage (applied across the primary winding). This results from a change in the magnetic coupling between the primary and secondary windings caused by the displacement of the rotor relative to the stator.

It is the principal object of the present invention to provide an RVDT of the type described wherein a plot of the output signal to displacement angle is linear over a wide range.

A further object is to provide such an RVDT which is extremely sensitive to changes in the displacement angle and reflects such changes in a corresponding change in the output voltage.

Still other objects and advantages will become apparent from the following description of a preferred embodiment of the invention.

SUMMARY OF THE INVENTION

The above and other beneficial objects and advantages are attained in accordance with the present invention by providing a rotary variable differential transformer having a stator with a circular rotor opening therethrough. First and second identical secondary coils extending along substantially adjacent quadrants of the periphery of the opening are connected to each other in series opposition. A primary coil is provided extending along substantially half the periphery of the opening. The rotor contains two diametrically opposed pole pieces in the form of arcuate segments of a common circle. One of the pole pieces has an arcuate length substantially equal to one half the combined arcuate length spanned by the secondary coils. The other pole piece has an arcuate length substantially equal to one third of the remainder of the opening periphery.

DETAILED DESCRIPTION OF THE PREFERRED EMBODIMENT

Figure 1:
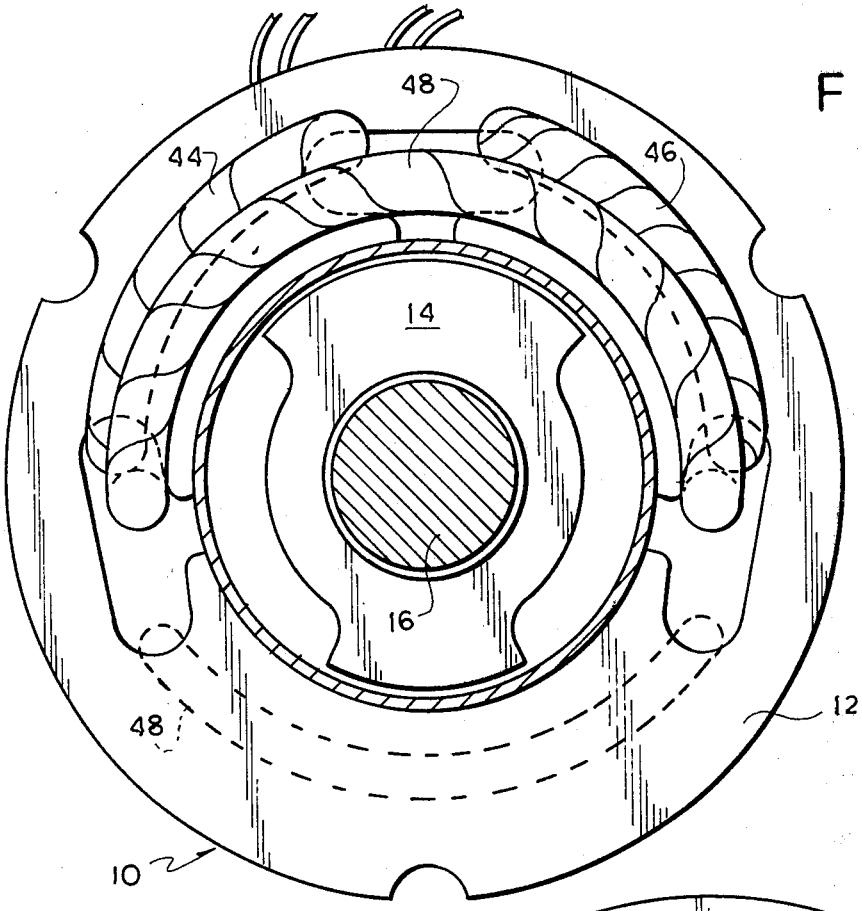
FIG. 1 is a plan view of the RVDT of the present invention.
Figure 2:
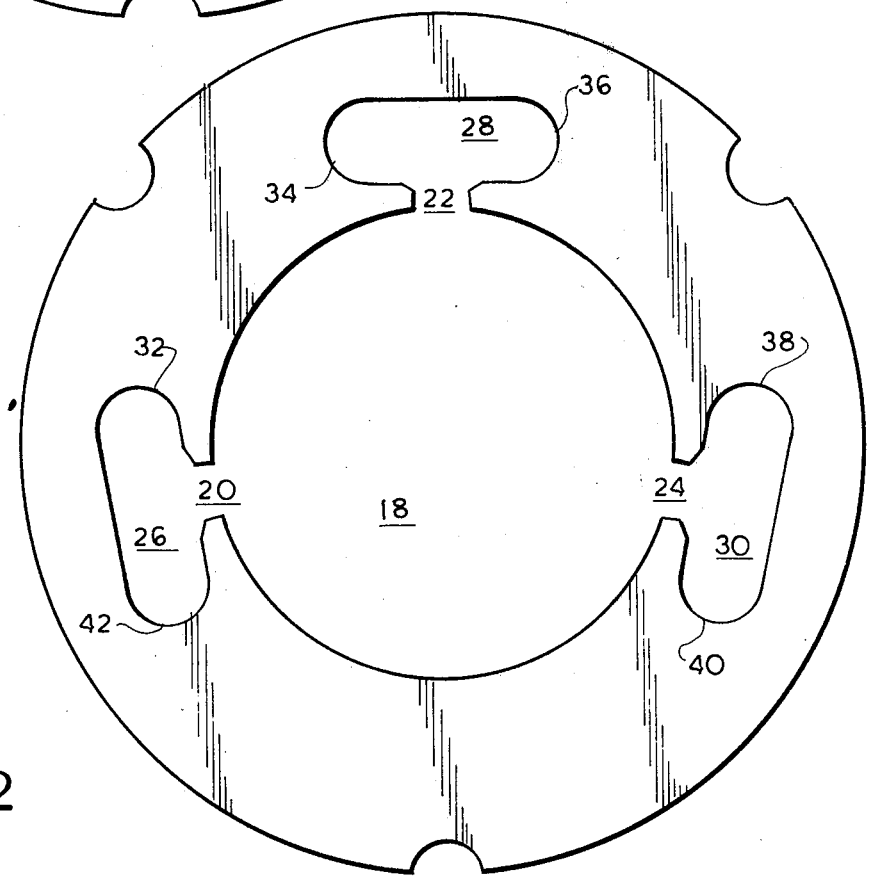
FIG. 2 is a plan view of a laminate of the stator of the RVDT of the present invention.

Reference is now made to the drawings and to FIG. 1 in particular wherein the RVDT 10 of the present invention is shown comprising a stator 12 and rotor 14. The rotor 14 is affixed to a shaft 16 which extends into and/or out of the plane of the drawing. Rotation of the shaft causes a rotation of rotor 14 and it is this rotation which the RVDT 10 detects and measures. The RVDT is housed within a casing (not shown) from which the shaft and various coil leads extend.

The stator 12 is formed of a stack of thin laminations of permeable material such as Hy - Mu 80. Referring to FIG. 1, it can be seen that the stator 12 is formed with a circular rotor opening 18 from which three slits 20, 22 and 24 extend radially outwardly. Slits 20 and 24 are each offset from slit 22 by angles of 101°. Oblong slots 26, 28 and 30 extend transversely from the outer ends of slits 20, 22 and 24 respectively. The ends of the slots 26, 28 and 30 define flanges to receive the coils of the transformer. Thus, flanges 32 and 34 define a first pair of flanges, flanges 36 and 38 define a second pair of flanges, and flanges 40 and 42 define a third pair of flanges. While ideally the first and second pair of flanges would each define a quadrant of the rotor opening, in practice this is not possible since some allowance must be made for coil buildup.

As shown in FIG. 1, a first secondary coil 44 is wound about the first pair of stator flanges 32 and 34. A second secondary coil 46, identical with the first coil, is wound about the second pair of stator flanges 36 and 38. The secondary coils 44, 46 are connected to each other in series opposition. A primary winding 48 overlies both secondary coils 44 and 46 extending between flanges 32 and 38. Alternately the primary winding 48 could be positioned between flanges 40 and 42 as shown in phantom in FIG. 1. In this regard, it should be noted that the arcuate lengths between (1) flanges 32 and 38 and (2) flanges 40 and 42 are equal and nominally equal to half the arcuate length of the rotor opening (again less allowance for the coils).

Figure 3:
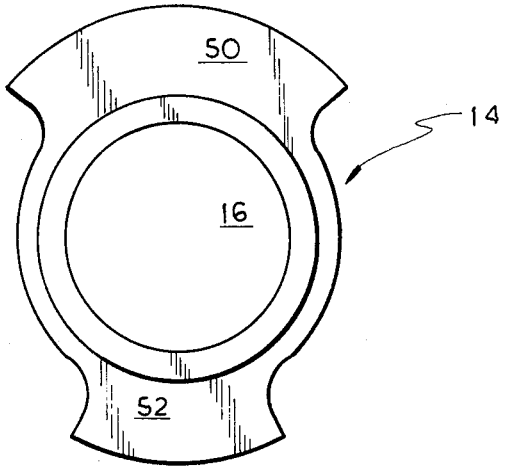
FIG. 3 is a plan view of the rotor of the RVDT of the present invention.
Figure 4:
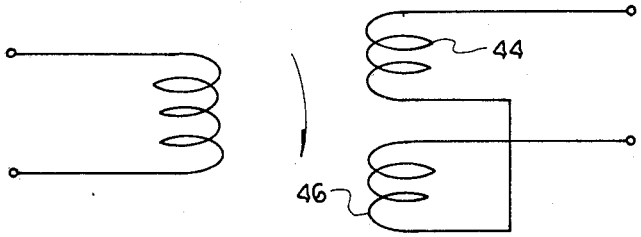
FIG. 4 is a schematic drawing of the RVDT of the present invention.

Rotor 14, shown in detail in FIG. 3, is formed of a permeable material such as Hy - Mu 80. Shaft 16 extends through a central opening in the rotor and is secured in position. The rotor is formed with two diametrically opposed pole pieces 50 and 52. The pole pieces define arcuate segments of a common circle substantially equal in diameter to the stator opening 18. The arcuate length of pole piece 50 is substantially equal to the arcuate length between slit 22 and either slit 20 or 24. The arcuate length of pole piece 52 is approximately $\frac{1}{3}$ the arcuate length between slits 20 and 24. In practice it was found that pole piece 50 should comprise an arc segment of $100° \pm 30'$ and pole piece 52 should comprise an arc segment of $57° \pm 30'$ to compensate for end effects.

Figure 5:
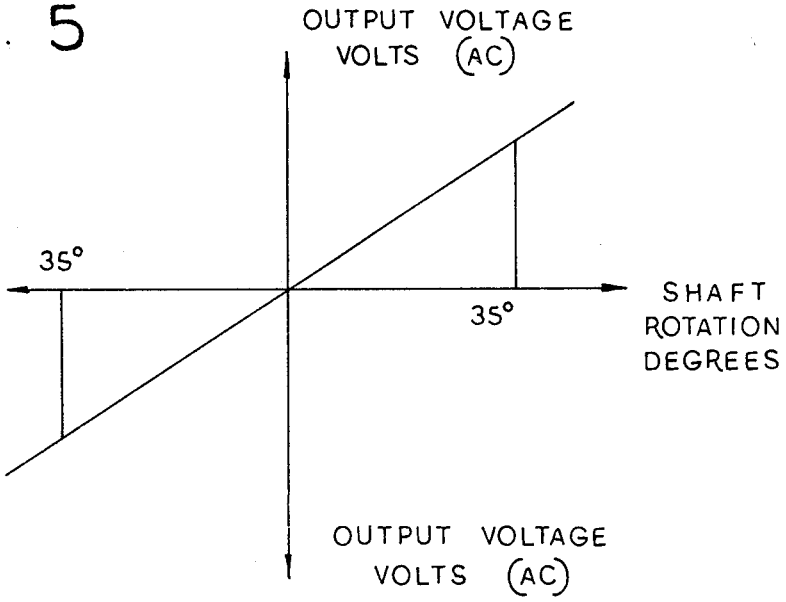
FIG. 5 is a plot of shaft rotation vs. output voltage.

The RVDT is in a null position when the rotor is symmetrically positioned with respect to the coils. This may be in the position shown in FIG. 1 or with the rotor large and small segments reversed. When an AC voltage is applied to the primary coils, the output voltage, measured across the secondary coils varies as a function of the position of the rotor from its null position as shown in FIG. 5. The output voltage is extremely linear for $\pm 35°$ from the null position.

Thus, in accordance with the above, the aforementioned objects are attained.

Having Thus Described the Invention, What is Claimed is:

1. A rotary variable differential transformer comprising: a stator having a circular rotor opening extending therethrough; first and second secondary coils connected to each other in series opposition extending arcuately along adjacent substantial quadrants of the periphery of said opening; a primary coil extending along substantially half the periphery of said opening; and a rotor positioned within said opening, said rotor having first and second diametrically opposed pole pieces, said first pole piece being equal in arcuate length to one half the combined arcuate length spanned by said secondary coils and said second pole piece being equal in arcuate length to one third the remainder of the periphery of said opening.

2. The invention in accordance with claim 1 wherein said primary coil extends over said secondary coils.

3. The invention in accordance with claim 1 wherein said pole pieces define segments of a common circle.

4. The invention in accordance with claim 1 wherein said stator is laminated.

5. The invention in accordance with claims 1, 2, 3 or 4 wherein said stator includes first, second and third pairs of flanges disposed about the periphery of said opening, said first secondary coil extends between the first pair of flanges and said second secondary coil extends between said second pair of flanges

6. The invention in accordance with claim 1 wherein said primary coil extends between said first pair of flanges.

7. The invention in accordance with claims 1, 2, 3, 4 or 6 wherein said stator includes first second and third pairs of flanges disposed about the periphery of said opening; first, second, and third slits extending into said stator from said opening; and one flange of each of said first and third pairs extend circumferentially from said first slit, one flange of each of said first and second pairs extend circumferentially from said second slit, and one flange of each of said second and third pair extend circumferentially from said third slit.

* * * * *